US005657964A

United States Patent [19]

Yoshida

[11] Patent Number: 5,657,964

[45] Date of Patent: Aug. 19, 1997

[54] ELECTRIC POWER TOOL FOR DRIVING JACK

[75] Inventor: Kazuhiko Yoshida, Saitama, Japan

[73] Assignee: Rikenkaki Kogyo Kabushiki Kaisha, Sakado, Japan

[21] Appl. No.: 566,896

[22] Filed: Dec. 4, 1995

[30] Foreign Application Priority Data

Sep. 5, 1995 [JP] Japan ..... 7-227812

[51] Int. Cl.[6] ..... B66F 3/00

[52] U.S. Cl. ..... 254/126; 254/122; 254/DIG. 2; 254/124; 254/134

[58] Field of Search ..... 254/124, 126, 254/122, DIG. 2; 269/249, 246, 240, 143

[56] References Cited

U.S. PATENT DOCUMENTS

| | | | |
|---|---|---|---|
| 1,375,236 | 4/1921 | Skinder | 269/240 |
| 1,918,469 | 7/1933 | Hargrave | 269/249 |
| 2,343,699 | 3/1944 | Petersen | 269/249 |
| 4,653,727 | 3/1987 | Chang et al. | 254/126 |
| 4,749,169 | 6/1988 | Pickles | 254/122 |
| 4,872,230 | 10/1989 | Levine | 254/126 |
| 4,943,034 | 7/1990 | Wagnon | 254/122 |
| 5,085,407 | 2/1992 | Lonon | 254/DIG. 2 |
| 5,211,375 | 5/1993 | Wang | 254/124 |
| 5,496,014 | 3/1996 | Hsu | 254/122 |

FOREIGN PATENT DOCUMENTS 5-40071 10/1993 Japan .

*Primary Examiner*—Timothy V. Eley
*Assistant Examiner*—Lee Wilson
*Attorney, Agent, or Firm*—Nikaido, Marmelstein, Murray & Oram LLP

[57] ABSTRACT

An electric driving unit is provided with a bracket. A slide plate is mounted on the bracket for sliding movement in a direction perpendicular to an axis of an output shaft of the electric driving unit. A first pivot holder is secured to one of side walls of the slide plate. A second pivot holder is mounted on the other side wall such that the second pivot holder can be adjusted in an advancing and retracting manner with respect to the first pivot holder. The first and second pivot holders are arranged such that they can hold opposite ends of any pivot shaft for various jacks even if the length of the shaft is different. With this arrangement, it is possible to provide an electric power tool for driving a jack which can be used for various types of jacks having pivot shafts of different lengths.

3 Claims, 10 Drawing Sheets

ELECTRIC POWER TOOL FOR DRIVING JACK

BACKGROUND OF THE INVENTION

1. Field of the Invention

The present invention relates to an electric power tool for electrically driving a jack for lifting and lowering the jack which is usually furnished in an automobile, and more particularly, to an improvement of an electric power tool for driving a jack, including: an electric driving unit including a normally and reversibly rotatable motor, a driving joint provided on an output shaft of the electric driving unit and capable of being connected and engaged with a driven joint of the jack, and a pivot holding means provided on a bracket supported by the electric driving unit for holding opposite ends of a pivot shaft of the jack, the jack being lifted or lowered by a rotation of the output shaft of the electric driving unit.

2. Description of the Prior Art

Such an electric power tool for driving a jack is already known as disclosed in Japanese Utility Model Publication No. 40071/93.

However, the known electric power tool is exclusively designed for a jack of a particular size. Therefore, whenever the size of the jack is changed, it is necessary to newly design another electric powder tool correspondingly. As a result, it is difficult to mass-produce such electric power tool and to reduce its manufacturing cost.

SUMMARY OF THE INVENTION

The present invention has been accomplished in view of the above circumstances, and it is an object of the present invention to provide an electric power tool which can drive various jacks of various size, and particularly, of various lengths of pivot shafts. According to the invention, it is possible to mass-produce the electric power tool and to reduce its manufacturing cost.

To achieve the above object, according to a first feature, there is provided an electric power tool for driving a jack, including: an electric driving unit including a normally and reversibly rotatable motor, a driving joint provided on an output shaft of the electric driving unit and capable of being connected and engaged with a driven joint of a jack, and a pivot holding means provided on a bracket supported by the electric driving unit for holding opposite ends of a pivot shaft of the jack, the jack being lifted or lowered by rotation of the output shaft of the electric driving unit, wherein the pivot holding means comprises: a slide plate connected to the bracket for sliding movement in a direction perpendicular to an axis of the output shaft, a first pivot holder provided on one of a pair of side walls formed on opposite ends of the slide plate in its sliding direction, and a second pivot holder which is provided on the other side wall of the slide plate such that the position of the second pivot holder can be adjusted in an advancing and retracting manner with respect to the first pivot holder, and which can hold the opposite ends of the pivot shaft of the jack in cooperation with the first pivot holder.

With the above arrangement, it is possible to reliably hold opposite ends of a pivot shaft of various sizes and types of jacks by the first and second pivot holders, and to always reliably connect the driving joint with the driven joint by a relative sliding movement between the bracket and the slide plate. Therefore, a single electric power tool can be coordinated with various jacks of different size, which makes it possible to mass-produce the electric power tool and to reduce its manufacturing cost.

In addition to the first feature, according to a second feature, the electric power tool further includes: a clamping bolt which is provided at a tip end thereof with the second pivot holder, the clamping bolt being axially movably supported by the other side wall of the slide plate; a nut threadingly engaged with the clamping bolt at a position inside the other side wall; and a nut-retaining plate provided on the slide plate for engaging an outer peripheral surface of the nut to prevent the nut from rotating at both of an inwardly moved position of the clamping bolt in which the nut is separated from an inner surface of the other side wall of the slide plate and an outwardly moving position of the clamping bolt in which the nut is brought into abutment against the inner surface of the other side wall.

With the above arrangement, the distance between the first and second pivot holders can largely be adjusted by the axial movement of the clamping bolt and the turning movement of the nut-retaining plate, which makes it possible to promptly adjust the electric power tool for a jack of different size.

The above and other objects, features and advantages of the invention will become apparent from the following description of a preferred embodiment described in conjunction with the accompanying drawings.

DESCRIPTION OF THE PREFERRED EMBODIMENT

The present invention will now be described by way of a preferred embodiment considered in conjunction with the accompanying drawings.

Figure 1:
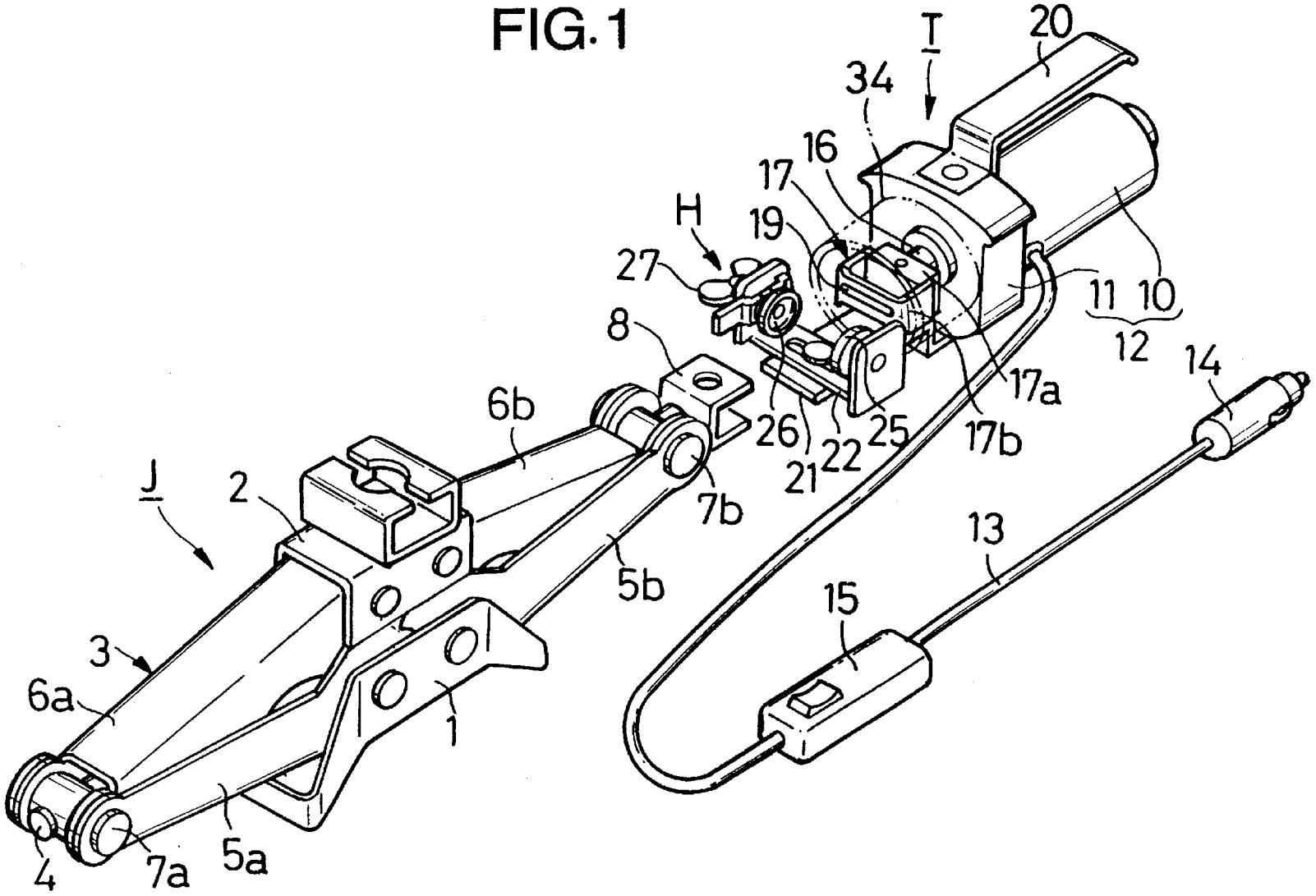
FIG. 1 is a perspective view of an electric power tool for driving a jack according to the present invention.
Figure 2:
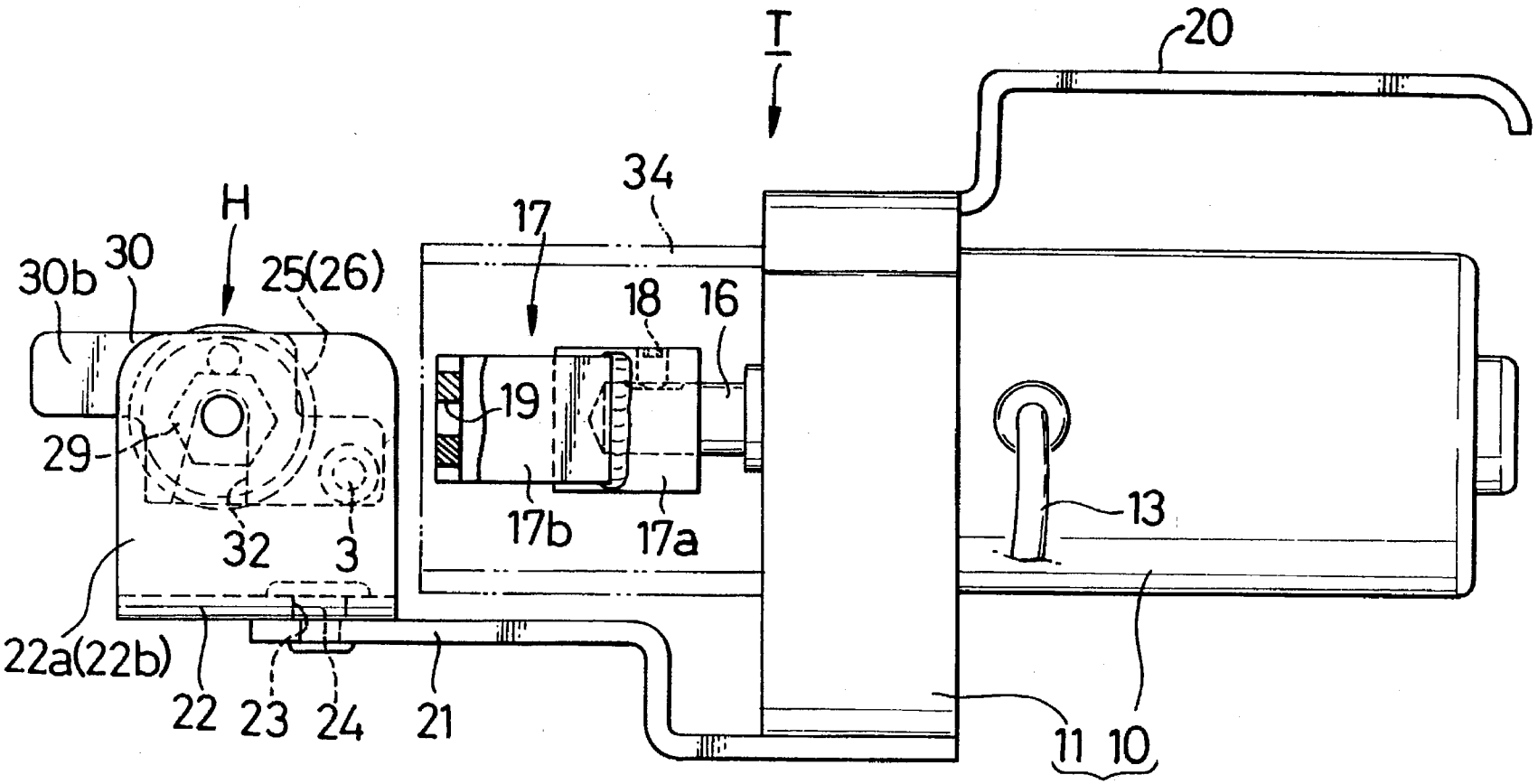
FIG. 2 is a side view of the electric power tool.
Figure 3:
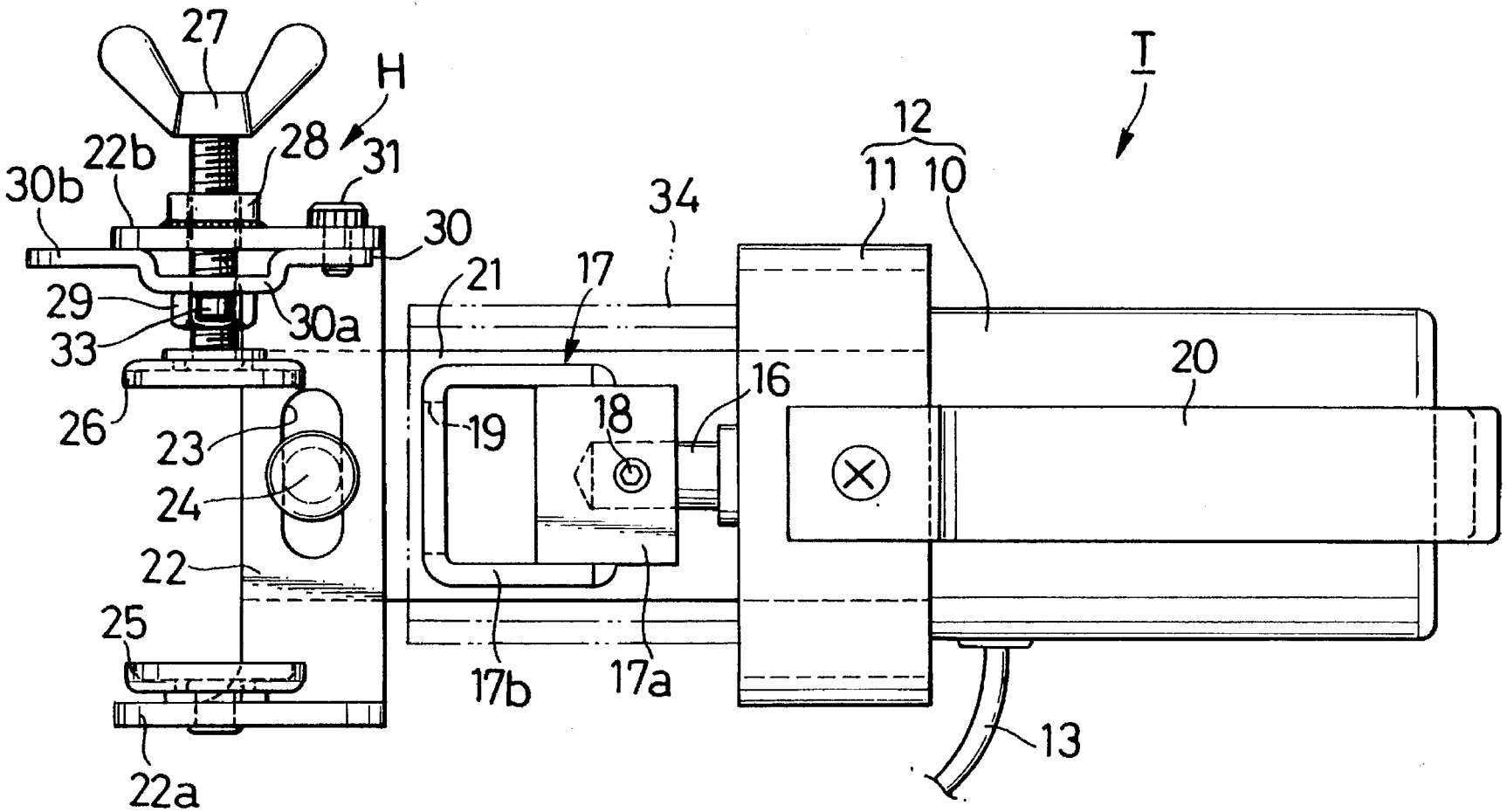
FIG. 3 is a plan view of the electric power tool.
Figure 4:
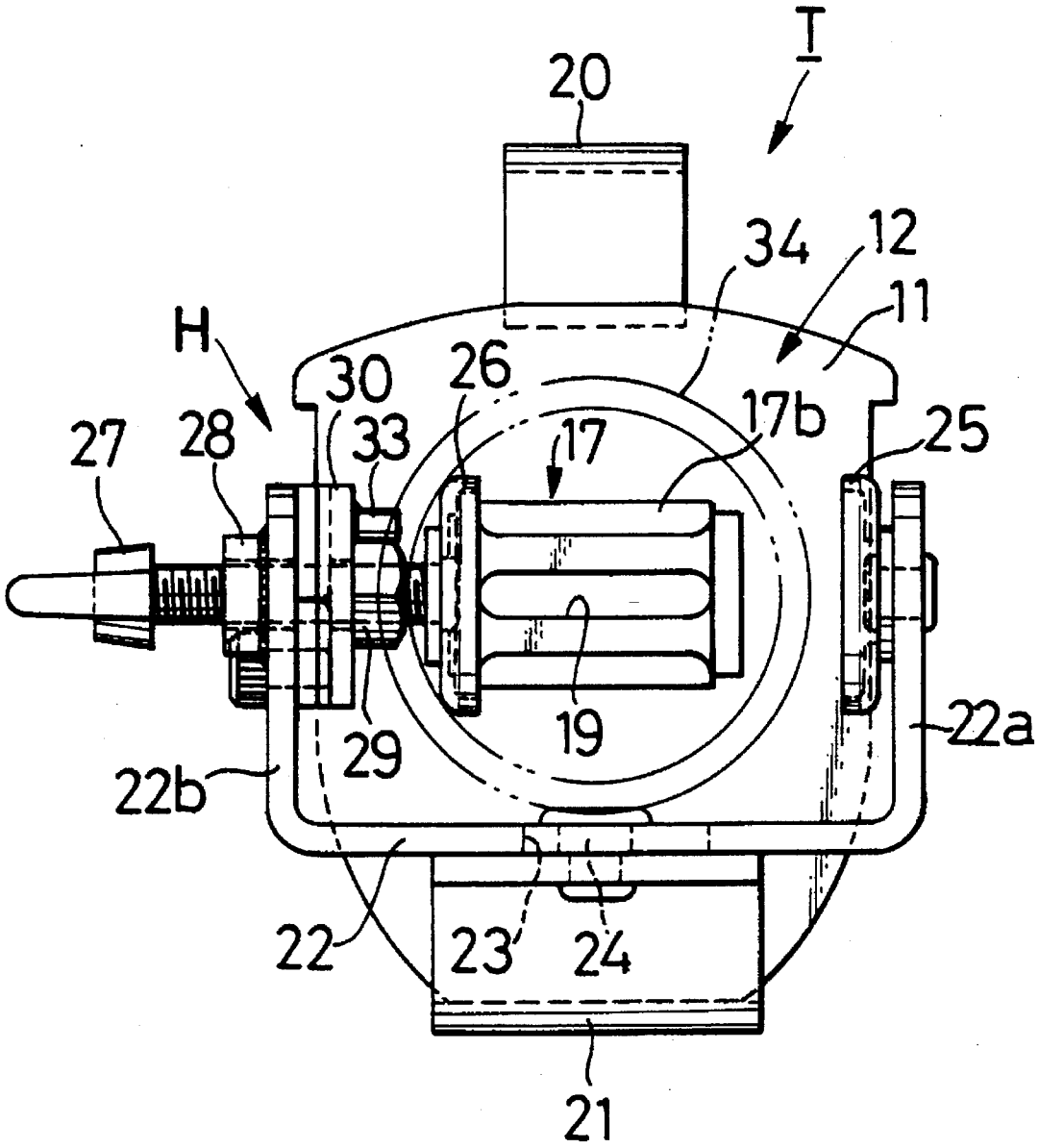
FIG. 4 is a front view of the electric power tool.

Referring to FIG. 1, a reference number "J" represents a jack for an automobile, and a reference number "T" represents an electric power tool for the jack.

Although the illustrated jack J is of a pantagraph type, any type of jack may be used. The jack J includes a pedestal 1, a load receiving block 2, a link mechanism 3 interposed therebetween for liftably connecting the load receiving block 2 to the pedestal 1, and a threaded rod 4 for lifting and lowering the load receiving block 2 through the link mechanism 3.

The link mechanism 3 includes a pair of front and rear lower arms **5*a* and 5*b* whose inner ends are pivotally connected to the pedestal 1, a pair of front and rear upper arms 6***a* and 6*b* whose inner ends are pivotally connected to the load receiving block 2, and a pair of front and rear pivot shafts 7*a* and 7*b*. The front pivot shaft 7*a* pivotally connects outer ends of the front lower and upper arms 5*a* and 6*a* and the rear pivot shaft 7*b* pivotally connects outer ends of the rear lower and upper arms 5*b* and 6*b*.

The threaded rod 4 is disposed such as to laterally pass through both the pivot shafts 7*a* and 7*b*. A tip end portion of the threaded rod 4 is threadingly inserted through the front pivot shaft 7*a*, and a base end of the threaded rod 4 is rotatably supported by the rear pivot shaft 7*b* in a manner so as to be substantially axially non-movable. A U-shaped driven joint 8 is secured to the base end of the threaded rod 4.

If the threaded rod 4 is rotated through the driven joint 8 such as to protrude from the front pivot shaft 7*a*, both the pivot shafts 7*a* and 7*b* approach to each other so that each of the arms 5*a*, 5*b*; 6*a*, 6*b* stands to lift the load receiving block 2. If the threaded rod 4 is rotated in the opposite direction, both the pivot shafts 7*a* and 7*b* are moved away from each other so that each of the upper arms 6*a* and 6*b* is brought toward each of the lower arms 5*a* and 5*b*, respectively, to thereby lower the load receiving block 2.

Next, the electric power tool T for driving the jack J will be described with reference to FIGS. 1 to 11. Referring first to FIGS. 1 to 4, the electric power tool T includes an electric driving unit 12 having a normally and reversibly rotatable DC motor 10 and a speed reducer 11 connected to a front portion of the DC motor 10. The motor 10 includes an electric cord 13. The electric cord 13 is provided at its end with a plug 14 which can be connected to a power source socket of the automobile. The electric cord 13 is also provided at its intermediate portion with a normally-opened type control switch 15 for causing the motor 10 to rotate reversibly. An output shaft 16 is projected from a front surface of the speed reducer 11 for reducing the speed of the rotation of a rotor shaft of the motor 10 to output the same, and a driving joint 17 is mounted to a tip end of the output shaft 16.

The driving joint 17 includes a joint block 17*a* which is secured to the output shaft 16 by a setscrew 18, and a U-shaped joint plate 17*b* which is welded at its opposite ends to the joint block 17*a* and is projected toward a front surface of the joint block 17*a*. The joint plate 17*b* has formed in its front wall an elongated connection hole 19.

A handle 20 is projected toward the motor 10 is secured to an upper surface of the speed reducer 11, and a bracket 21 is projected toward the output shaft 16. The handle 20 is secured to a lower surface of the speed reducer 11. A slide plate 22 is mounted to the bracket 21 at a forward position of the driving joint 17 such that the slide plate 22 can slide in a lateral direction perpendicular to an axis of the output shaft 16. More specifically, the slide plate 22 is formed with a slotted hole 23 extended in its sliding direction, and a guide shaft 24 which is relatively slidably fitted through the slotted hole 23 is secured to the bracket 21.

The slide plate 22 has a U-shaped cross section and includes a pair of left and right side walls 22*a* and 22*b* arranged in a sliding direction of the slide plate 22 so as to oppose to each other. A cup-like shallow first pivot holder 25 is secured to the left side wall 22*a* and is capable of engaging a left outer end of the rear pivot shaft 7*b*. The right side wall 22*b* is formed with a boss 28 for slidably supporting a butterfly-shaped clamping bolt 27. A cup-like shallow second pivot holder 26 which can engage a right outer end of the rear pivot shaft 7*b* is rotatably connected to a tip end of the clamping bolt 27. A nut 29 is threadingly engaged through the clamping bolt 27 between the right side wall 22*b* and the second pivot holder 26. A nut-retaining plate 30 is rotatably mounted at its one end to the right wall 22*b* through a bolt 31 for engaging an outer peripheral surface of the nut 29 to prevent the nut 29 from rotating.

The nut-retaining plate 30 includes a bulged portion 30*a* which protrudes so as to be distanced from an inner surface of the right side wall 22*b*. The bulged portion 30*a* is formed with a U-shaped notch 32 for receiving a screw portion of the clamping bolt 27. A pressure pin 33 is secured to the bulged portion 30*a* for abutting against and holding an outer peripheral surface of the nut 29 to prevent the nut 29 from rotating when the notch 32 receives the screw portion of the clamping bolt 27. Depending upon a location of the nut 29, the notch 32 engages the outer peripheral surface of the nut 29 for preventing the nut 29 from rotating.

A knob 30*b* is formed at a tip end of the nut-retaining plate 30. A transparent protective cover 34 made of synthetic resin, is mounted to the speed reducer 11 for covering an outer periphery of the driving joint 17.

The slide plate 22, the first and second pivot holders 25 and 26, the clamping bolt 27, the nut 29 and the nut-retaining plate 30 compose a pivot holding means H which can hold the rear pivot shaft 7*b* of the jack J irrespective of the length of the pivot shaft 7*b*.

Next, the operation of the embodiment will be described below.

Figure 5:
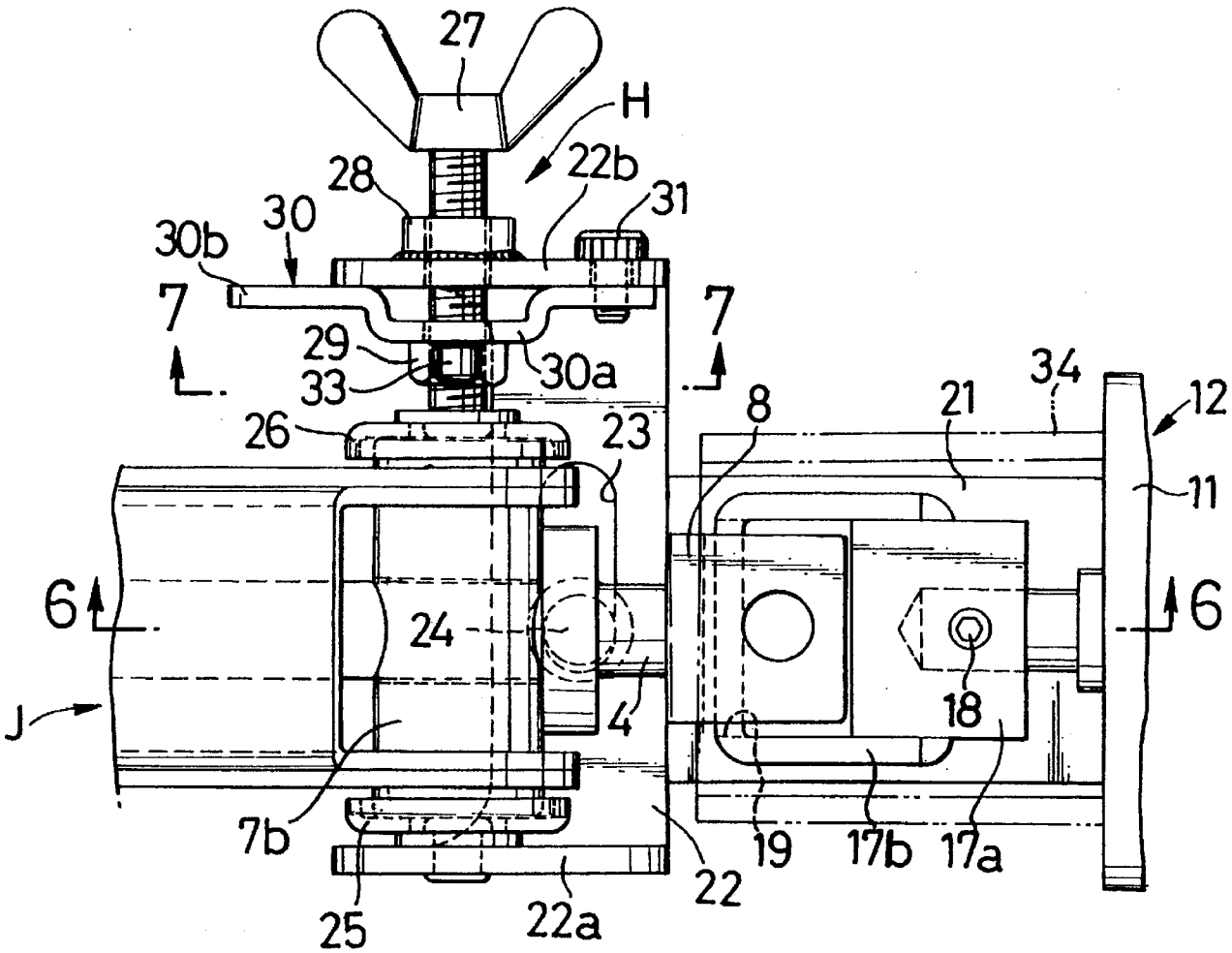
FIG. 5 is a plan view of an essential portion of the electric power tool connected to a small jack.
Figure 6:
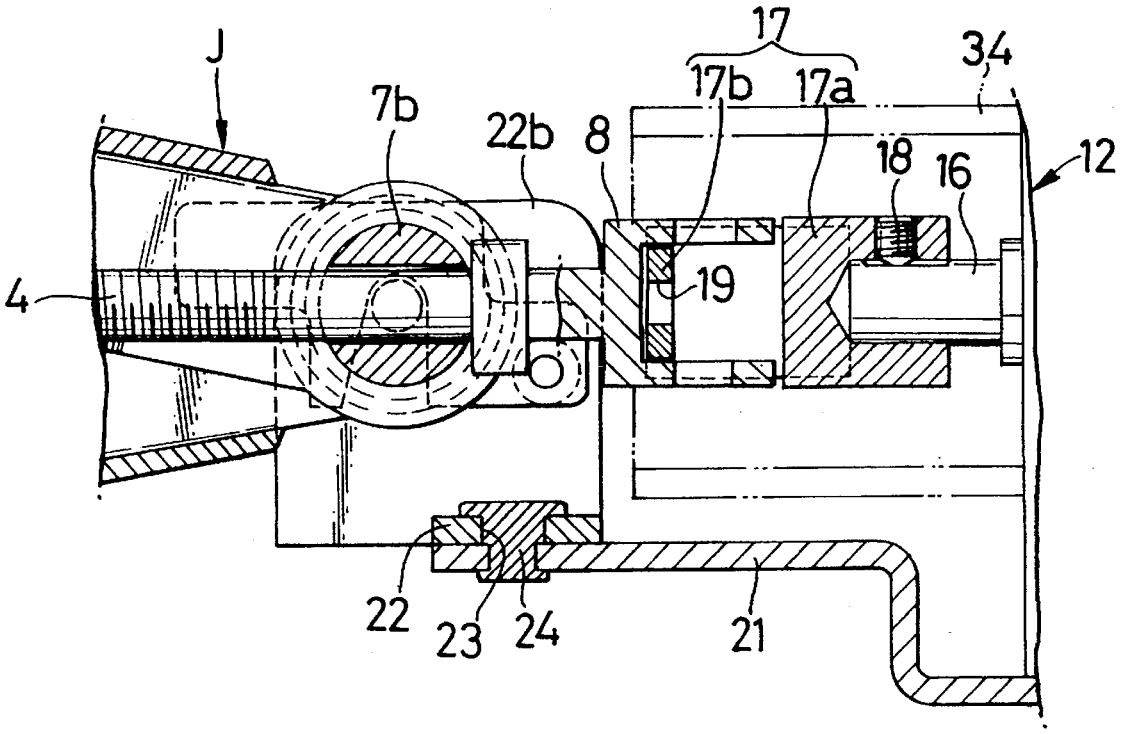
FIG. 6 a sectional view taken along a line 6—6 in FIG. 5.
Figure 7:
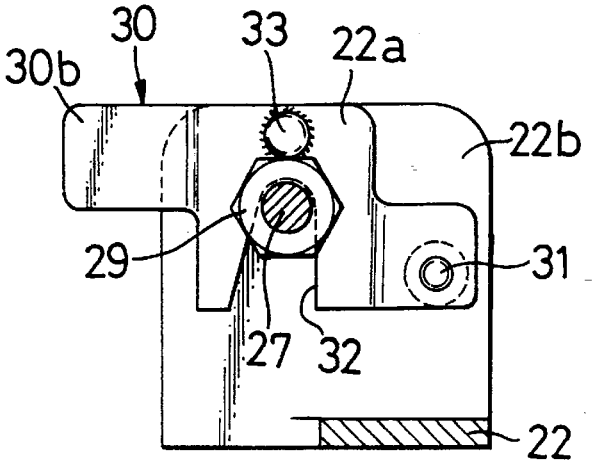
FIG. 7 a sectional view taken along a line 7—7 in FIG. 6.

When the electric power tool T is used for driving the jack J, the driving joint 17 of the electric power tool T is first engaged within the U-shaped driven joint 8 of the jack J as shown in FIGS. 5 and 6. Then, opposite ends of the rear pivot shaft 7*b* of the jack J are held by the first and second pivot holders 25 and 26 in a manner described below.

Figure 8:
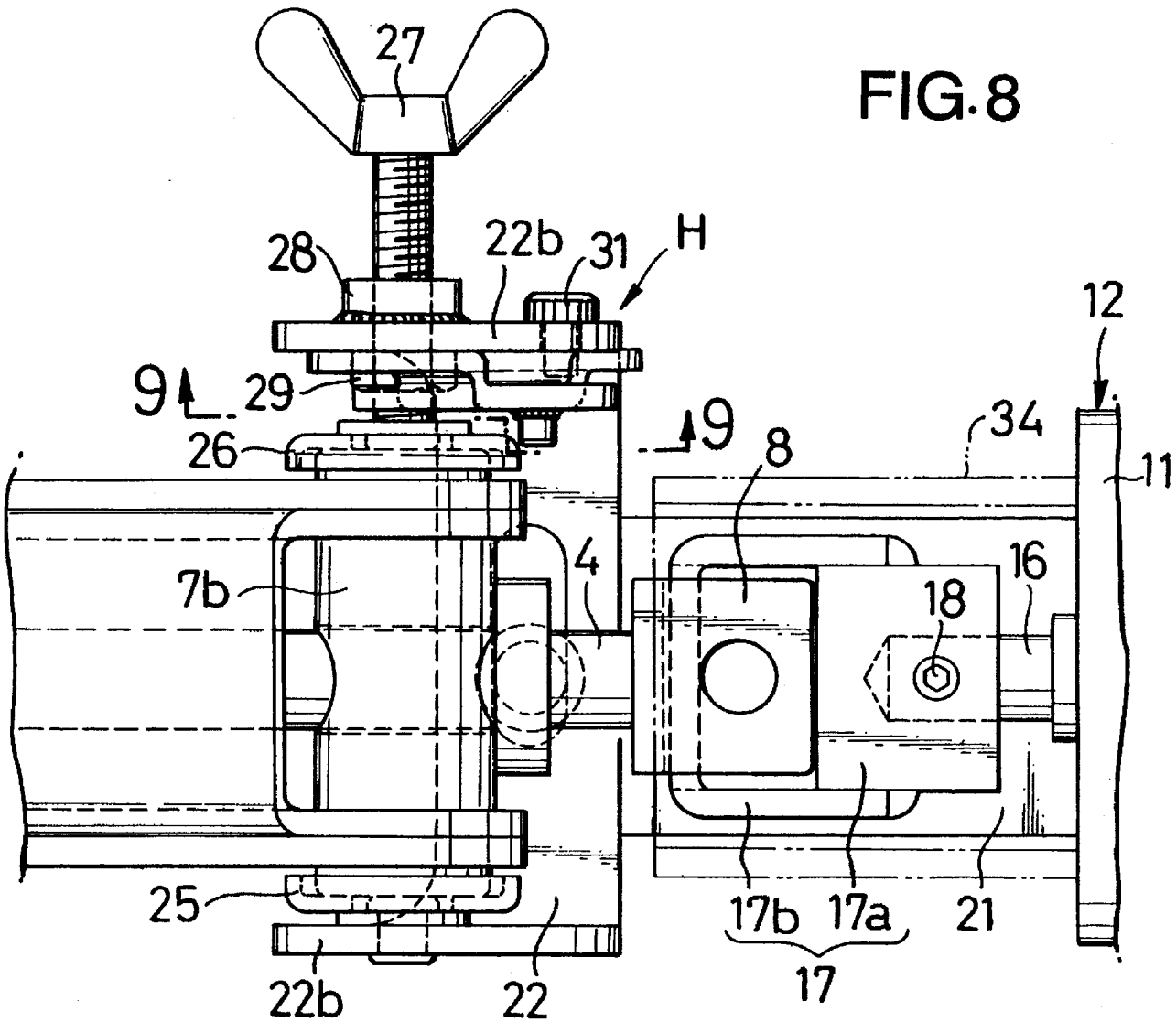
FIG. 8 is similar to FIG. 5 but illustrating a plan view of an essential portion of the electric power tool connected to a big jack.
Figure 9:
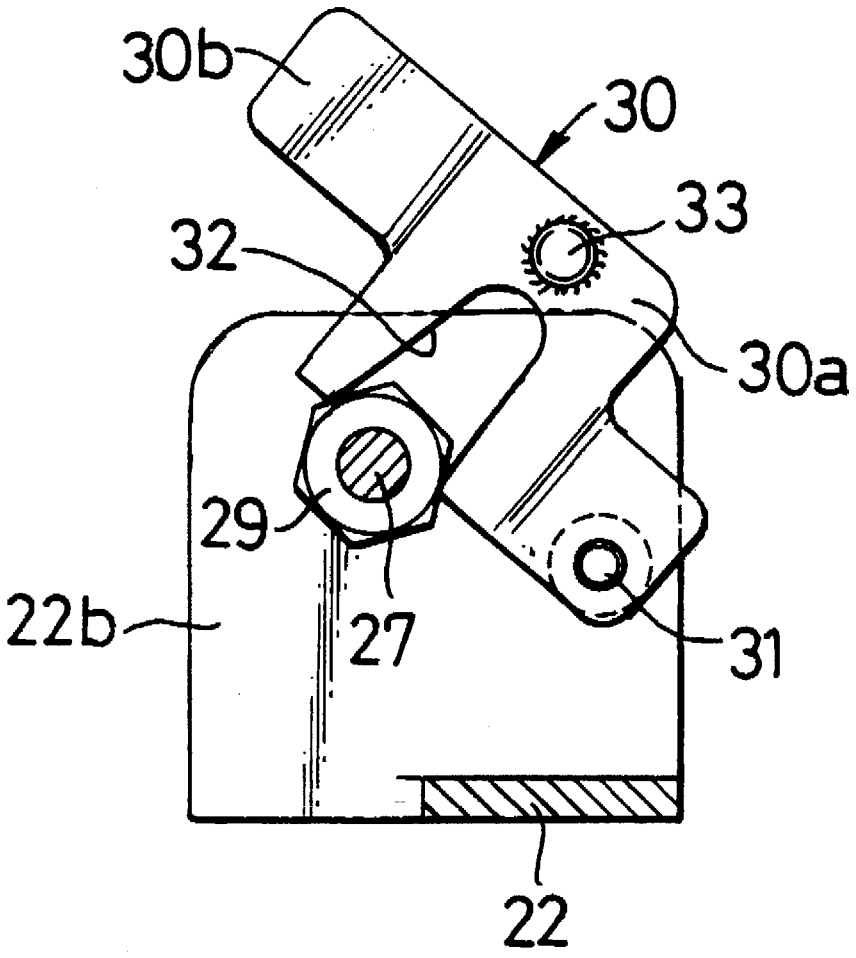
FIG. 9 a sectional view taken along a line 9—9 in FIG. 8.

As shown in FIGS. 5 and 8, a length of each of the pivot shafts 7*a* and 7*b* of the jack J varies depending upon a size of the jack J. When the pivot shaft 7*b* is relatively short as shown FIG. 5, the clamping bolt 27 is first pushed inwardly of the right side wall 22*b* of the slide plate 22 and then, the nut-retaining plate 30 is turned down such that the notch 32 receives the screw portion of the clamping bolt 27, and the outer peripheral surface of the nut 29 is held by the pressure pin 33 for fixing the nut 29 (see FIGS. 5 to 7). If the clamping bolt 27 is rotated in its clamping direction, the opposite ends of the rear pivot shaft 7*b* which is relatively short can be clamped and held by the first and second pivot holders 25 and 26.

When the pivot shafts 7*a* and 7*b* are relatively long as shown in FIG. 8, the nut-retaining plate 3 is first turned up to a position where the plate 30 does not interfere wit the nut 29, and then, the clamping bolt 27 is pulled outward of the right side wall 22*b* to bring the nut 29 into abutment against an inner surface of the right side wall 22*b*. Next, the nut-keeping plate 30 is turned down such that the notch 32 engages an outer peripheral surface of the nut 29 to prevent the nut 29 from rotating. Then, if the clamping bolt 27 is rotated in its clamping direction, opposite ends of the rear pivot shaft 7*b* which is relatively long can be held by both the pivot holders 25 and 26.

A distance between both the pivot holders 25 and 26 can largely and easily be varied by turning the nut-retaining plate 30 and by axially moving the clamping bolt 27 in this manner. Therefore, it is possible to hold the rear pivot shaft 7*b* irrespective of its length, by rotating the clamping bolt 27 through relatively small number of rotations.

During that time, the bracket 21 is slid in either of the left and right directions with respect to the slide plate 22 so as to bring the axes of both the joints 8 and 17 into agreement with each other.

Thereupon, the plug 14 of the electric cord 13 is connected to the electric socket of the automobile and the control switch 15 is operated for normal or reverse rotation. By this, the motor 10 is rotated in a normal or reverse direction and such rotation is reduced in speed by the speed reducer 11 to drive the threaded rod 4 in a normal or reverse direction through the output shaft 16 and both the joints 17 and 8. Therefore, the load receiving block 4 can be lifted or lowered. At that time, a reaction force torque of the output shaft 16 is supported by the jack J through the bracket 21 and the pivot holding means H.

Figure 10:
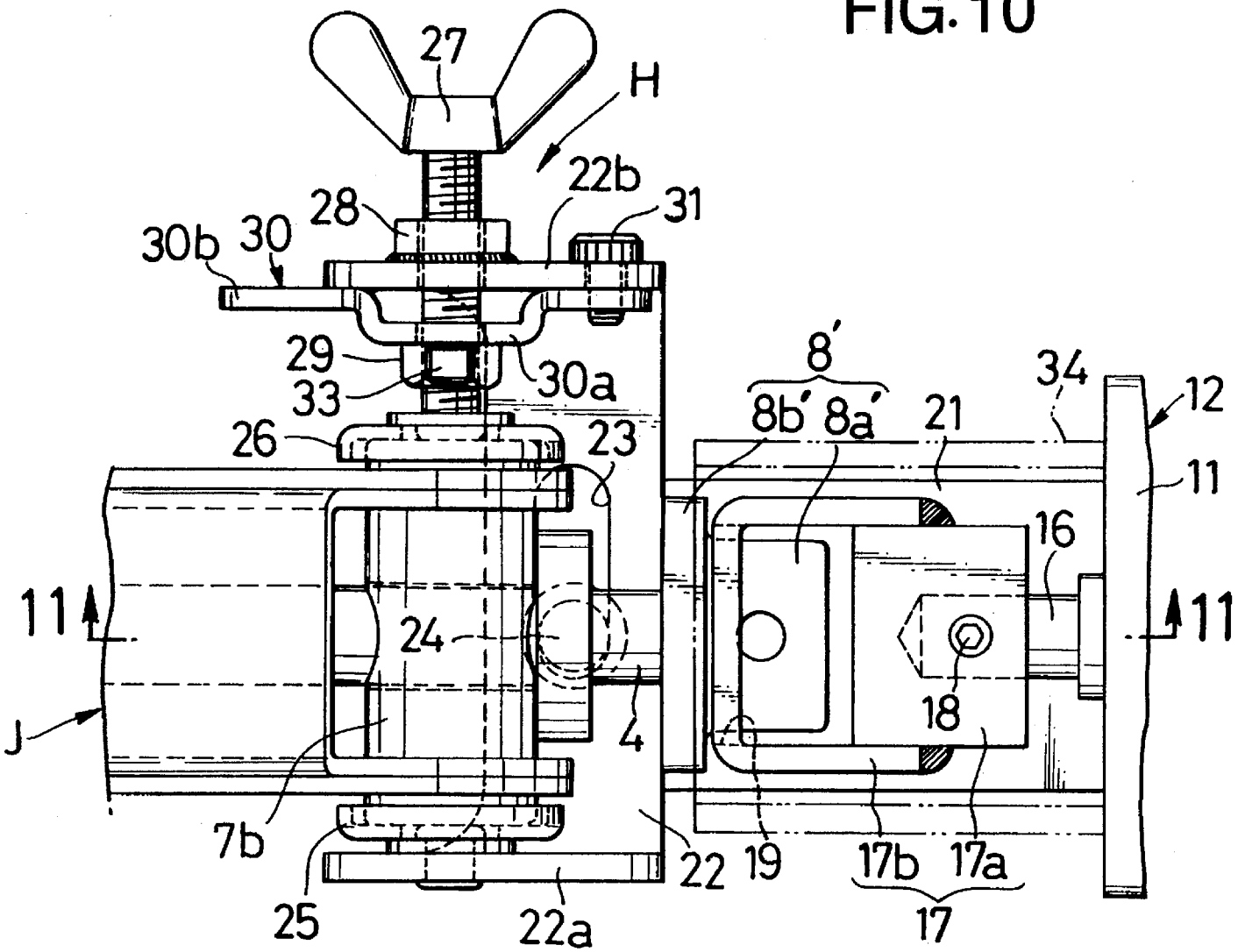
FIG. 10 is similar to FIG. 5 but illustrating a plan view of an essential portion of the electric power tool connected to a T-shaped jack.
Figure 11:
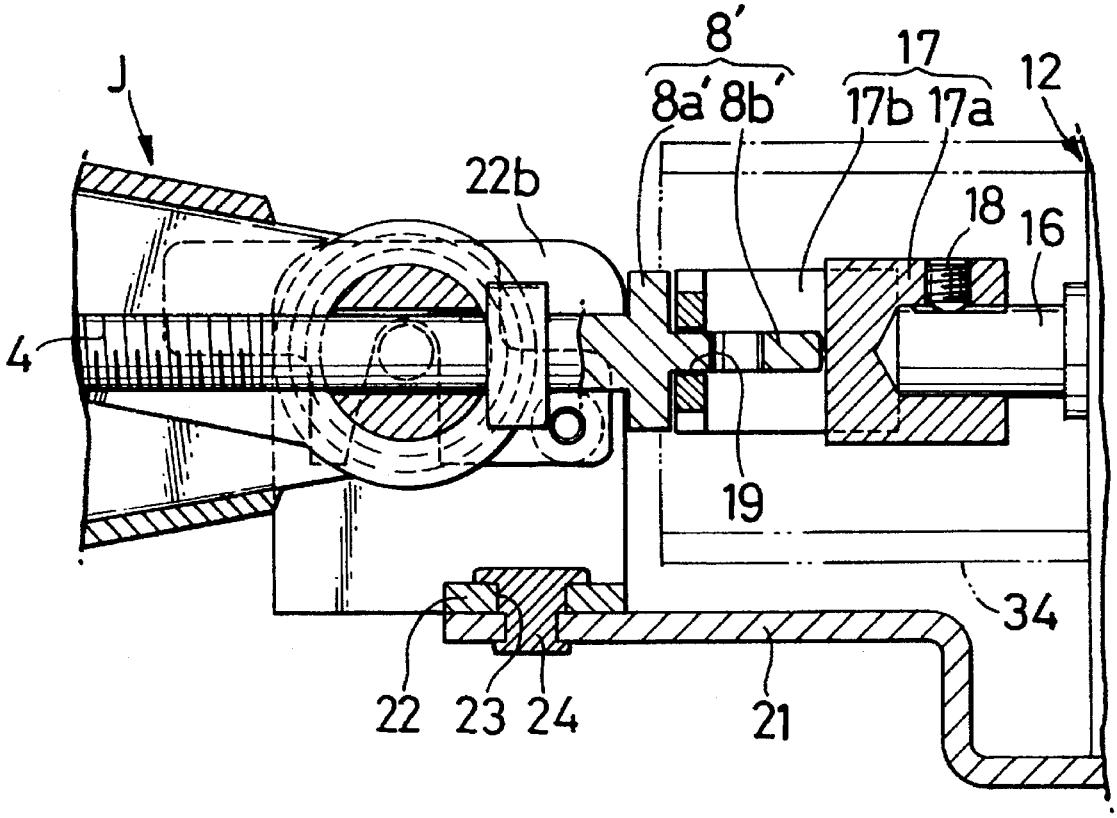
FIG. 11 a sectional view taken along a line 11—11 in FIG. 10.

FIGS. 10 and 11 illustrate an electric power tool T in which a T-shaped joint having a connection plate **8*b*' projectingly provided on a flange 8*a*' on a base end of the threaded rod 4 is employed as a driven joint 8' of the jack J. In order to operate such jack J, the connection plate 8*b*' of the driven joint 8' is inserted into the elongated connection hole 19 of the driving joint 17 so as to bring the flange 8*a*' into abutment against a front surface of the driving joint 17. The rear pivot shaft 7*b* is held by both the pivot holders 25 and 25** in the same manner as described above.

Therefore, if the motor 10 is operated, the rotation of the output shaft 16 can be transmitted from the driving joint 17 through the connection plate **8*b*' of the driven joint 8' to the threaded rod 4**.

Although embodiments of the present invention have been described in detail, it will be understood that the present invention is not limited to the above-described embodiment, and various modifications in design may be made without departing from the spirit and scope of the invention defined in claims. For example, the clamping bolt 27 can directly be threadingly engaged with the boss 28 of the bracket 21 without using the nut 29 and the nut-keeping plate 30.

What is claimed is:

1. An electric power tool for driving a jack, comprising: an electric driving unit including a normally and reversibly rotatable motor, a driving joint provided on an output shaft of said electric driving unit which is capable of being connected and engaged with a driven joint of a jack, and a pivot holding means provided on a bracket supported by said electric driving unit for holding opposite ends of a pivot shaft of said jack, said jack being lifted or lowered in response to rotation of said output shaft of said electric driving unit, wherein said pivot holding means comprising:

a slide plate connected to said bracket for sliding movement in a direction perpendicular to an axis of said output shaft, a first pivot holder provided on one of a pair of side walls formed on opposite ends of said slide plate in its sliding direction, a second pivot holder which is provided on the other side wall of said slide plate such that the position of said second pivot holder can be adjusted in an advancing and retracting manner with respect to said first pivot holder, and which can hold the opposite ends of said pivot shaft of said jack in cooperation with said first pivot holder a clamping bolt provided at a tip end of said second pivot holder, said clamping bolt being axially movably supported by said other side wall of said slide plate, a nut threadingly engaged with the clamping bolt at a position between said other side wall and said second pivot holder, and nut-retaining plate provided on said slide plate for engaging an outer peripheral surface of said nut to prevent the nut from rotating at both of:

an inwardly disposed position of said clamping bolt in which said nut is separated from an inner surface of said other side wall of said slide plate, and an outwardly disposed position of said clamping bolt in which said nut is brought into abutment against the inner surface of said other side wall.

2. An electric power tool for driving a jack according to claim 1, wherein said nut-retaining plate is pivotally supported on the other side wall of said slide plate for swinging movement along said inner surface of the other side wall, and said nut-retaining plate includes a notch for engaging an outer peripheral surface of said nut to prevent the nut from rotating when said clamping bolt is in said inwardly disposed position, and a side projection for engaging the outer peripheral surface of said nut to prevent the nut from rotating when said clamping bolt is in said outwardly disposed position and nut-retaining plate is moveable so that said clamping bolt is received in said notch.

3. An electric power tool for driving a jack according to claim 1 or 2, wherein said second pivot holder is rotatably coupled to a tip end of said clamping bolt.

* * * * *